US006095339A

United States Patent [19]

Filip

[11] Patent Number: 6,095,339

[45] Date of Patent: Aug. 1, 2000

[54] SIEVE BOX SCREEN AND PAN CLEANER

[75] Inventor: Hans Dieter Filip, Gutersloh, Germany

[73] Assignee: Filip GmbH, Gutersloh, Germany

[21] Appl. No.: 09/323,530

[22] Filed: Jun. 1, 1999

[30] Foreign Application Priority Data

Jun. 4, 1998 [DE] Germany ..... 198 25 617

[51] Int. Cl.[7] ..... B07B 01/54

[52] U.S. Cl. ..... 209/382; 209/385; 209/386; 209/379; 209/381; 209/405

[58] Field of Search ..... 209/379, 382, 209/384, 385, 387, 389, 381, 325, 326, 331, 332, 405

[56] References Cited

U.S. PATENT DOCUMENTS

| | | | |
|---|---|---|---|
| 699,026 | 4/1902 | Shaler | 209/387 |
| 711,133 | 10/1902 | Snyder | 209/382 |
| 754,821 | 3/1904 | Shultz | 209/387 |
| 1,799,416 | 4/1931 | Gillespie | 209/387 |
| 1,965,157 | 7/1934 | Rice | 209/381 |
| 2,086,199 | 7/1937 | Williams | 209/387 |
| 2,304,325 | 12/1942 | Williams et al. | 209/323 |
| 2,455,383 | 12/1948 | Pickard | 209/379 |
| 3,422,955 | 1/1969 | Mock et al. . | |
| 3,565,251 | 2/1971 | Pennington . | |
| 4,288,320 | 9/1981 | Wilson . | |
| 5,051,171 | 9/1991 | Hukki . | |
| 5,538,139 | 7/1996 | Keller . | |

FOREIGN PATENT DOCUMENTS

| | | |
|---|---|---|
| 2952215 | 7/1981 | Germany . |
| 3802799 | 1/1988 | Germany . |

*Primary Examiner*—Donald P. Walsh
*Assistant Examiner*—David A. Jones
*Attorney, Agent, or Firm*—Burd, Bartz & Gutenkauf

[57] ABSTRACT

A sieve box for a particulate sifter has a pan, a screen, and a number of screen and pan clearing devices. Each device has a first member with fingers engageable with the pan to remove particulates that accumulate on the pan and a second member with fingers adapted to engage the screen to clean the screen or particulates. The first and second members have cooperating structures that movably connect the structures to allow free combined lateral movement in the sieve box and independent relative rotational, vertical and wobble movements.

36 Claims, 10 Drawing Sheets

SIEVE BOX SCREEN AND PAN CLEANER

FIELD OF THE INVENTION

The invention relates to devices for separating different sizes of particulates, such as ground grain products to form flours, semolinas, and middlings. The devices have sieve boxes with screens cleared of particulates with movable screen cleaners.

BACKGROUND OF THE INVENTION

Devices for separating grain mill particulates have been developed to sift and sort different sized particulates into fine and coarse classifications. Gyratory sifters, called plansifters, used for sifting dry, free flowing materials have a number of sieve decks superimposed one upon another which function to provide large capacity separation of materials in different particle size classifications. These sifters are utilized for purifying flour, grains and cereal flakes by removing large objects and particles from the desired fine particles preparatory to packaging. Examples of these types of sifters are disclosed by W. L. Mock and W. Taylor in U.S. Pat. No. 3,422,955 and A. Keller in U.S. Pat. No. 5,538,139. The sieve decks or sieve boxes in sifters have screen or mesh sizes from fine to coarse. The sifters have centrifugal drives which import circular motions to the sieve boxes. The fine particulates flow through the screens and settle on pans. The particulates move along the pans to exit openings in the sides of the sieve boxes. The coarse particulates move along the top of the screens to discharge channels along the sides of the sieve boxes.

Many ground grain particulates have poor sifting properties due to high humidity and particle size. The screens clog up with particulates which reduces the sieve output of the sifters. Screen cleaners have been incorporated in sieve boxes to clear particulates from the screens during the sifting operation of the sifter. The screen cleaners are free moving objects, such as balls, rings, and spoke structures that randomly contact the screens to separate particulates from the screens. Examples of screen cleaners used in sieve boxes are found in the following U.S. patents. C. S. Pennington in U.S. Pat. No. 3,565,251 discloses a sieve assembly having a box frame supporting a sieve structure and a carrier for sieve cleaners. The sieve cleaners are rubber-like balls that are free to move in compartments in the carrier to clear articles from the sieve structure and carrier. The balls have limited contact with the sieve structure as only a relatively small convex curved surface of each ball engages the sieve structure. A. M. Hukki in U.S. Pat. No. 5,051,171 discloses a self cleaning system for vibratory screens that uses one-piece screen cleaning elements shown as cylindrical or ring members. The screen cleaning elements are free to move and bounce below the screen during gyration of the separator machine. The cleaning elements contact the screen to separate materials from the screen and clear materials from a perforated pan. A. Keller in U.S. Pat. No. 5,538,139 discloses a sieve box with one-piece sieve cleaners that clean the sieve screen and clear product from a pan. The sieve cleaners have a number of arms, a wobble foot, and knobs, bristles or cleaning ribs on the arms for removing product from the sieve screen during gyration of the sieve box.

SUMMARY OF THE INVENTION

The invention is a sieve box for screen separator machines known as plansifters used to separate particulates into a plurality of particle size classificatiions. The particulates include milled grains to form flours, semolinas and middlings. The sieve box has a frame supporting a pan and a screen located above the pan. One or more screen and pan clearing devices located between the pan and screen are free to rotate, wobble and move in lateral and vertical directions during circular movement or gyration of the sieve box to effectively clear particulates from the screen and move particulates along the pan to particulate exit openings. The screen and plate clearing device has a first member having a plurality of first fingers engageable with the pan to remove particulates that accumulate on the pan. A second member located above the first member has a plurality of second fingers adapted to engage the screen to remove particulates from the screen so as to clean the screen during the sifting operation. The first and second fingers are linear knobs having convex-shaped outer ends. Alternative structures for the first and second fingers are spaced groups or pods of bristles. The first and second members have cooperating structures that movably connect the members whereby the members have free combined lateral movement within an area between the pan and screen and at the same time have independent relative rotational, vertical and wobble movements. These movements of the first and second members cause the first and second fingers to effectively clear particulates from the pan and screen.

The preferred embodiment of the sieve box has a rectangular frame having side members and cross members dividing the space surrounded by the frame into separate areas. A pan attached to the side members closes the bottom of the frame. A screen attached to the side members is spaced above the pan. The mesh size of the screen can vary from fine to coarse. A pan and screen particulate clearing device is located in each area of the sieve box between the pan and screen.

Each clearing device has a pan clearing member having a generally flat triangular body and downwardly directed first fingers joined to the body along the outer edges of the body. The body has a plurality of vertical holes which allow particulates to flow through the body. The first fingers are spaced from each other to permit particulates to move between adjacent fingers. The clearing device includes a screen clearing member having a generally triangular body and upwardly directed second fingers located below the screen and adapted to contact the screen for clearing particulates that have collected on the screen. The second fingers are spaced from each other and located along the outer edges of the screen clearing member. The body of the screen clearing member has a number of holes to allow particulates to flow through the screen clearing member and prevent particulates from collecting on the screen clearing member. The screen clearing member has a downwardly directed leg or post having a lower end engageable with the pan to support the body and second fingers above the pan and adjacent the screen. The post fits in one of the holes in the body of the pan cleaner so that both clearing members laterally move together and each clearing member has independent rotational, vertical and wobble movements during gyration movements of the sieve box. The combined movements of the pan and screen clearing members effectively clears particulates from the screen and facilitates movement of particulates along the pan to the particulate exit openings in the side members of the sieve box. The screen and pan clearing device provides increased output of particulates of the siieve box as it optimizes screen clearing and base clearing of particulates by independent and combined movements of the screen and pan clearing members. These and other advantages of the sieve box and pan and screen clearing devices of the invention are embodied in the sieve box having the pan and particulate clearing devices shown in the drawings and described in the following description of the preferred embodiments thereof.

DESCRIPTION OF PREFERRED EMBODIMENTS OF THE INVENTION

A sieve box 10, shown in FIGS. 1 to 7, for a plansifter employed in the milling industry for sifting milled products, such as flour, semolina and middlings, herein called particulates. Plansifers are gyration sifters that have a plurality of sieve boxes for separating different sized particulates of milled products. An example of a plansifter is disclosed by A. Keller in U.S. Pat. No. 5,538,139. The particulates in addition to milled products include granular materials, such as corn, wheat, rye, barley, rice, seeds, sand, soil, and plastics.

Figure 4:
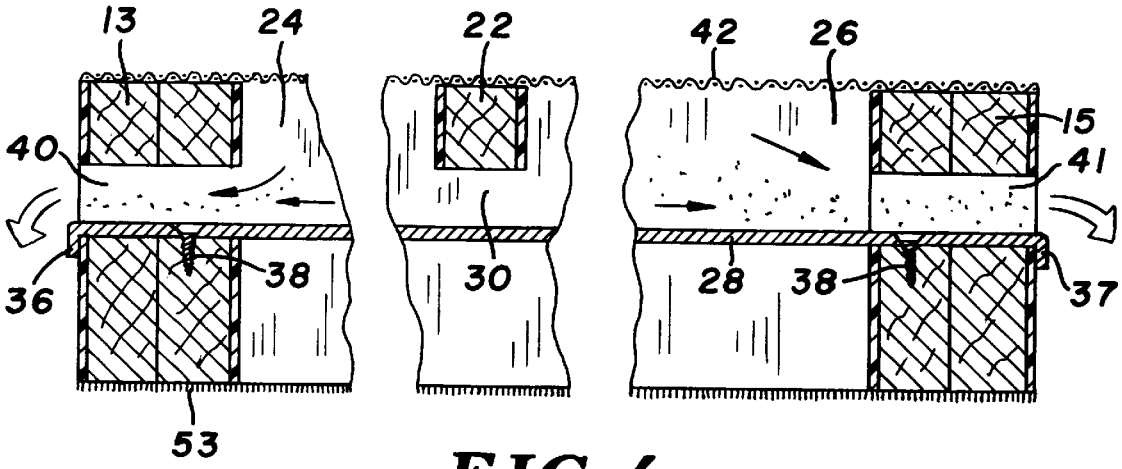
FIG. 4 is an enlarged foreshortened sectional view taken along the line 4—4 of FIG. 1.
Figure 5:
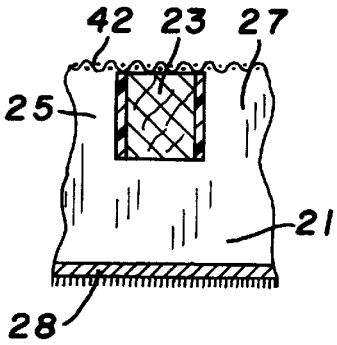
FIG. 5 is an enlarged sectional view taken along the line 5—5 of FIG. 1.

Sieve box 10 has a square frame 11 comprising linear side members 12, 13, 14, and 15 joined to cross members 16 and 17. A transverse divider member 18 extended between and secured to the middle sections of members 12 and 16. Member 16 is spaced inward of frame member 12 to provide space between member 12 and 16. This space is divided into coarse material discharge channels 19 and 20. A transverse divider 18 separates channels 19 and 20. A first sieve cleaner stop member 22 extended transversely between members 16 and 17 divides sieve box 10 into two zones 24 and 26. A second sieve cleaner stop member 23 extended transversely between members 17 and 35 divides sieve box 10 into two additional zones 25 and 27. Each zone 24, 25, 26 and 27 has an area of one fourth of the total area of all the zones. As shown in FIG. 5, the bottom of member 23 is spaced above a flat pan 28 forming a passage 21 between zones 25 and 27. The bottom of member 22, shown in FIG. 4, is spaced above pan 28 forming a passage 30 between zones 24 and 26. The particulates in zones 24 and 26 are free to flow between these zones.

Figure 1:
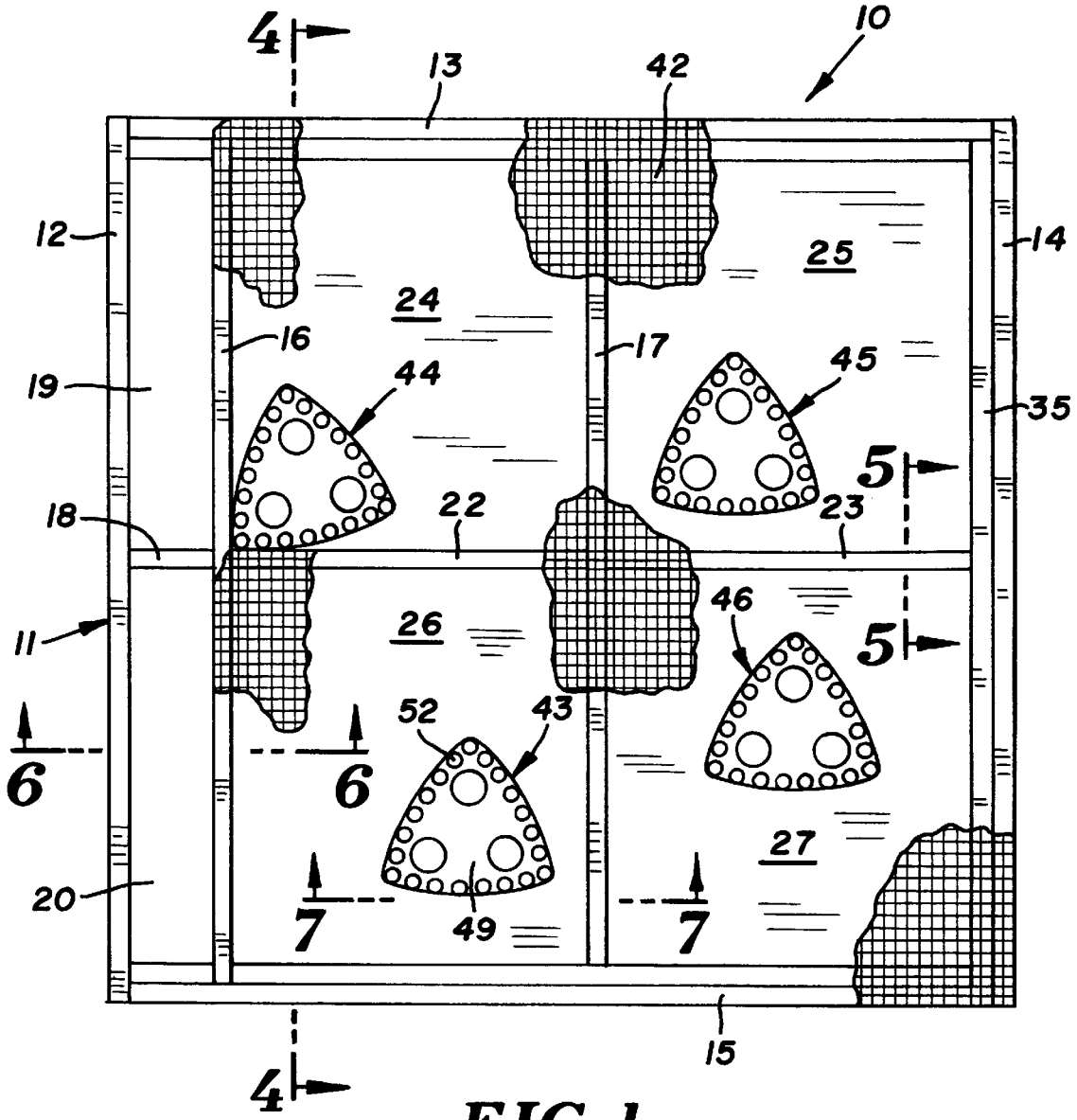
FIG. 1 is a plan view, partly broken away, of the top of a sieve box having the sieve pan cleaners of the invention.
Figure 2:
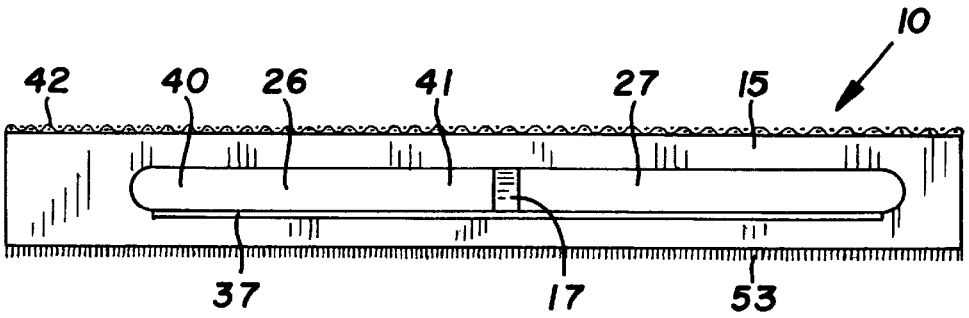
FIG. 2 is an elevational view of one end of the sieve box of FIG. 1.
Figure 3:
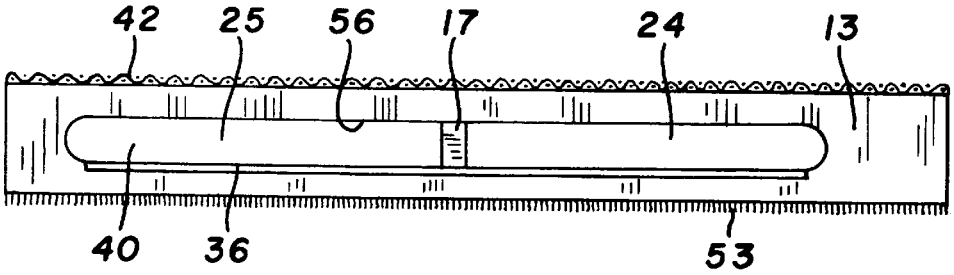
FIG. 3 is an elevational view of the other end of the sieve box of FIG. 1.
Figure 6:
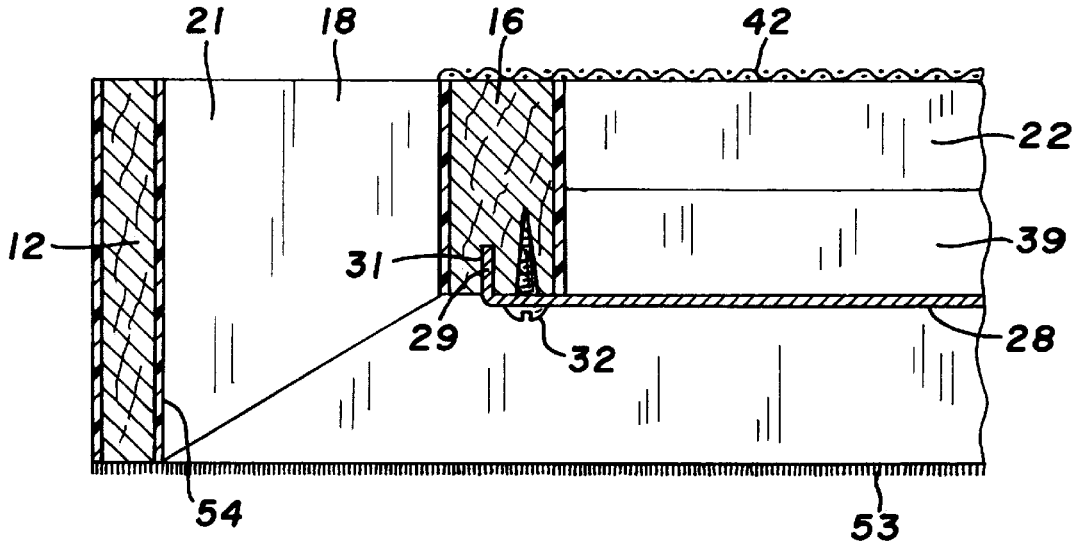
FIG. 6 is an enlarged sectional view taken along the line 6—6 of FIG. 1.

Side member 13, shown in FIG. 3, has a horizontal slot or opening 40 forming a horizontal passage open to zones 24 and 25. As shown in FIG. 2, side member 15 has an elongated horizontal slot or opening 41 providing a horizontal passage open to zones 26 and 27. Pan 28 extends through the bottom of passages 40 and 41. Screws 38 attach pan 28 to members 13 and 15. As seen FIG. 4, pan 28 has a downwardly projected lip 36 bearing against the outside of side member 13. The opposite end of pan 28 has a downwardly projected lip 37 bearing against the outside of side member 15. Lips 36 and 37 reinforce the lateral positions of side members 13 and 15 and maintain the square configuration of sieve box 10. As shown in FIG. 6, member 16 has a linear bottom groove 29 accommodating an upright flange 31 along the edge of pan 28. Screws 32 hold pan 28 on member 16. Member 35 has a bottom linear groove (not shown) for an upright flange of pan 28.

A screen 42 covers zones 24–27 and is secured to the top surfaces of side members 13, 14, 15 and 16, cross member 17 and sieve cleaner stop members 22 and 23. The mesh or size of the screen varies from fine, such as 80 microns, to coarse. An adhesive is used to bond screen to members 13–17, 22 and 23. The screen can be made of a plastic fiber material or metal wire.

Pan and screen clearing devices or cleaners 43, 44, 45 and 46 located in zones 24, 25, 26 and 27 are free to move in all spatial directions in their respective zones to clear screen 42 of particulates and keep pan 28 clear of particulates. The particulates deposited on pan 28 move along pan 28 and through side slots 40 and 41. Cleaners 43–46 are identical in structure. The following description is directed to cleaner 43.

Figure 7:
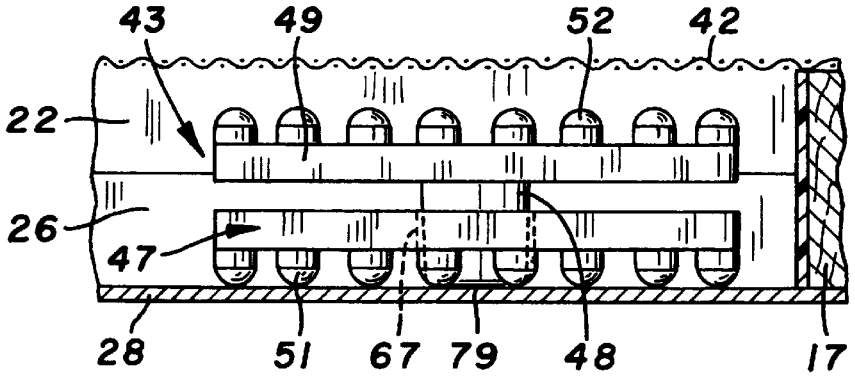
FIG. 7 is an enlarged sectional view taken along line 7—7 of FIG. 1.
Figure 8:
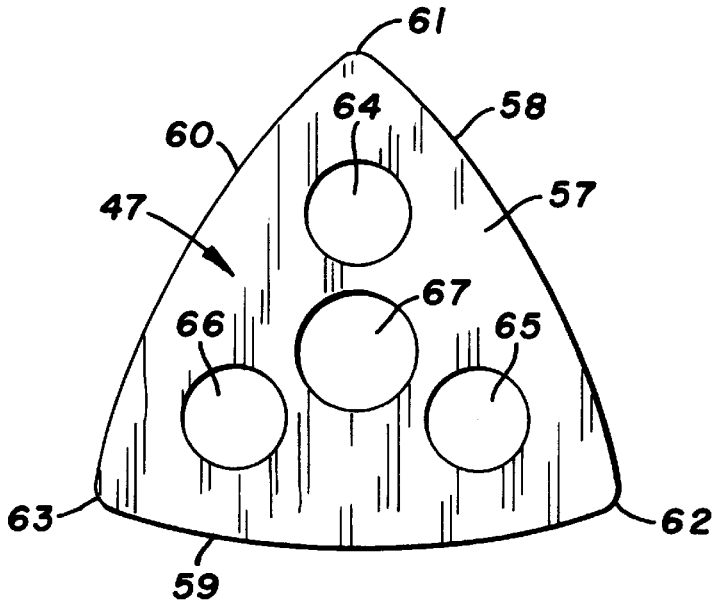
FIG. 8 is a top plan view of the first member of the sieve and pan cleaner.
Figure 9:
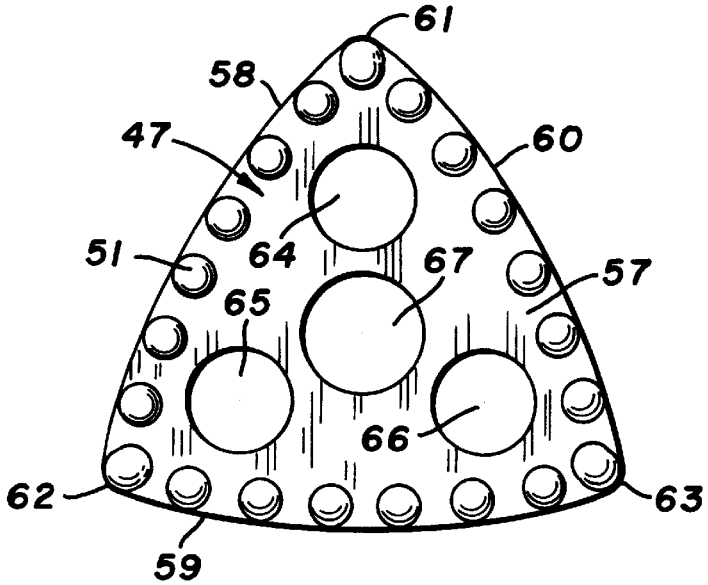
FIG. 9 is a bottom plan view of first member of the sieve and pan cleaner of FIG. 9.
Figure 10:
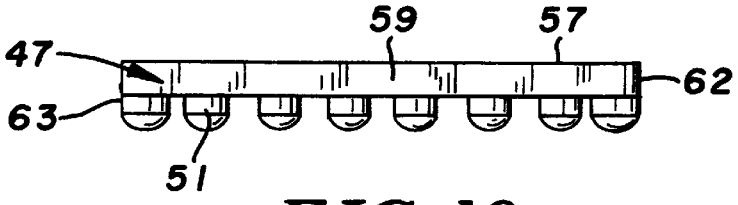
FIG. 10 is a side elevational view of one side of the first member of the sieve and pan cleaner of FIG. 1.

As shown in FIG. 7, cleaner 43 has a pan cleaning member 47 and a screen cleaning member 49. Member 49 has central downwardly extended cylindrical leg or post 48 having a bottom end 79 that rides on pan 28. Member 47, shown in FIGS. 8, 9 and 10, has a generally triangular body 57 with three outwardly curved sides 58, 59 and 60 joined at rounded corners 61, 62 and 63. The top surface of body 57 is flat. The bottom of body 57 has a plurality of downwardly extended fingers or tines 51. As seen in FIG. 9, fingers 51 are located in rows along the outer peripheral edges of the body adjacent sides 58, 29 and 60. Adjacent fingers 51 are spaced from each other to allow particulates to flow between the fingers and outwardly away from body 57. Outside portions of fingers 51 are extensions of sides 58, 59 and 60. Each corner 61, 62 and 63 accommodates a corner finger having a generally oval cross section. The fingers 51 between the corner fingers have circular cross sections. Body 57 has three off-center holds 64, 65 and 66 surrounding a center hole 67. Holes 64–67 have diameters to accommodate post 48. Returning to FIG. 7, when post 48 is inserted in hole 67, member 49 is spaced above member 47 and is free to rotate about the axis of post 48 and wobble relative to member 47.

Figure 11:
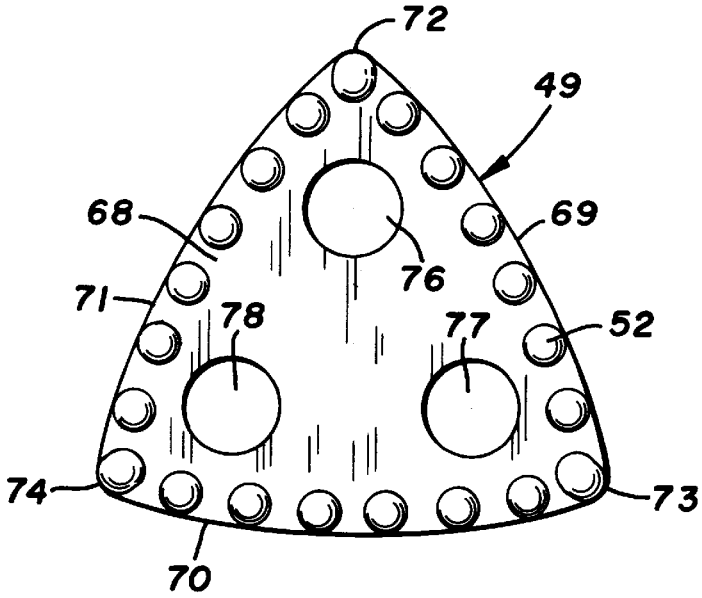
FIG. 11 is a top plan view of the second member of the sieve and pan cleaner.
Figure 12:
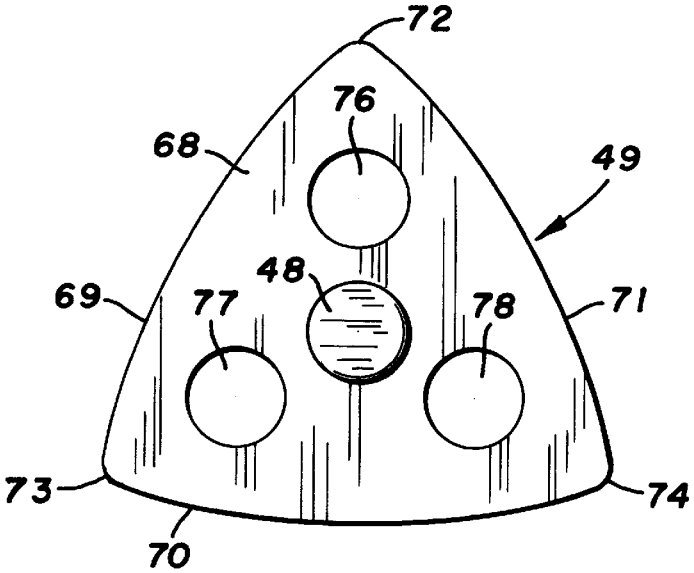
FIG. 12 is a bottom plan view of the second member of the sieve and pan cleaner of FIG. 11.
Figure 13:
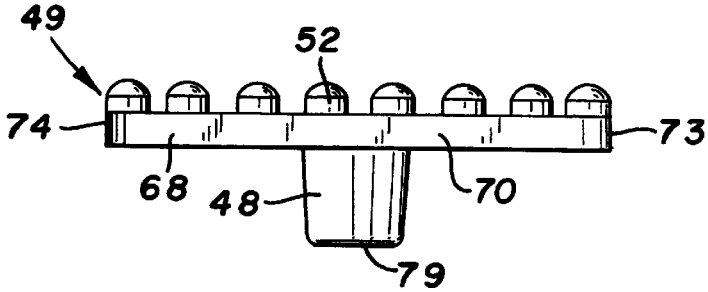
FIG. 13 is a side elevational view of one side of the second member of the sieve and pan cleaner of FIG. 11.

As shown in FIGS. 11 to 13, screen cleaning member 49, has a body 68 with three outwardly curved sides 69, 70 and 71 joined with rounded corners 72, 73 and 74. Post 48 is joined to the middle of the bottom of body 68. The holes 76, 77 and 78 are located midway between post 48 and corners 72, 73 and 74 to allow particulates to flow through body 68. The top of body 68 has a plurality of upright fingers or tines 52 which are located in rows along the sides 69, 70 and 71. Adjacent fingers 52 are spaced from each other to allow particulates to flow past adjacent fingers 52. Particulates on top of body 68 can flow through holds 76, 77 and 78 and through the spaces between fingers 52.

The bodies 57 and 68 of clearing members 47 and 49 have an equilateral triangular configuration with convex-shaped or arched side walls. Each side wall has an arcuate length of 120 degrees and a radius of 11.5 cm. Other triangular shapes can be used for bodies 57 and 68. Body 57 and fingers 51 are a one-piece plastic member. Body 68, post 48, and fingers 52 are a one-piece plastic member. The plastic material is wear resistant and has a low coefficient of friction to inhibit collection of particulates on clearing members 47 and 49.

Figure 14:
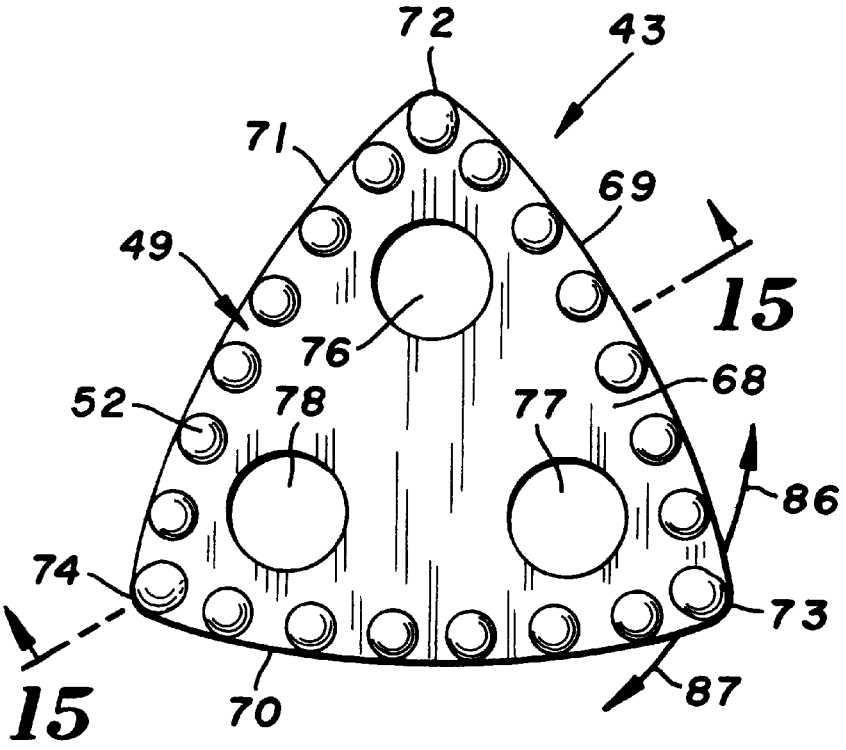
FIG. 14 is a top plan view of the sieve and pan cleaner.
Figure 15:
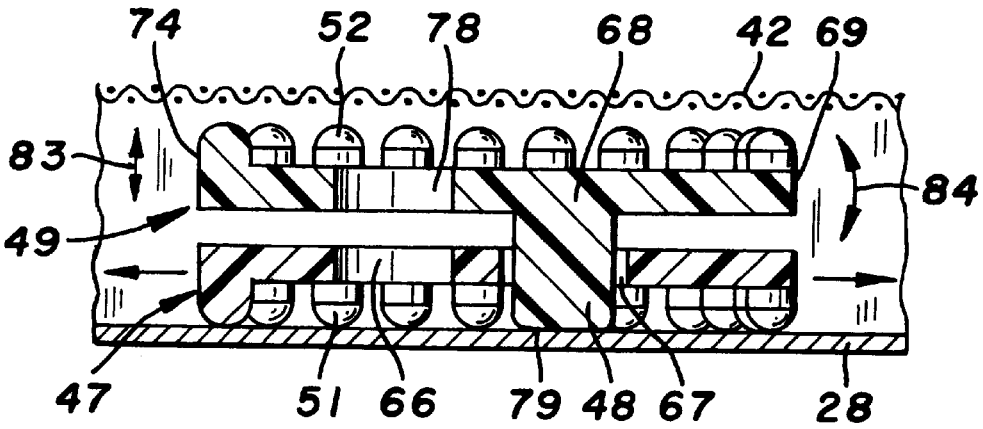
FIG. 15 is a sectional view taken along line 15—15 of FIG. 14 with the sieve and pan cleaner located in the sieve box.

As shown in FIGS. 14 and 15, members 47 and 48 are in operative assembled relationship between pan 28 and screen 42. Fingers 51 of member 47 ride on pan 28. Post 48 extends through hole 67 in member 47 also rides on pan 28. Hole 67 is larger than the diameter of post 48 allowing member 49 to move up and down, as shown by arrow 82, and wobble relative to the axis of post 48, as shown by arrow 84. Member 49 is free to rotate about the vertical axis of post 48, as shown by arrows 86 and 87. Pan cleaning member 47 also has vertical, rotational and tilting or wobble movements below member 49. The members 47 and 49 laterally move together around the zone.

In use the plansifter has a centrifugal or gyration drive which imparts a circular or gyration motion to all of the sieve boxes. The particulates are fed into the top of the plansifter and the sorted particulates are discharged from the bottom of the plansifter. Sieve boxes, such as sieve box 10, separate the coarse and fine particulates. The size of the mesh of screen 42 determines the particulate size classification.

Figure 16:
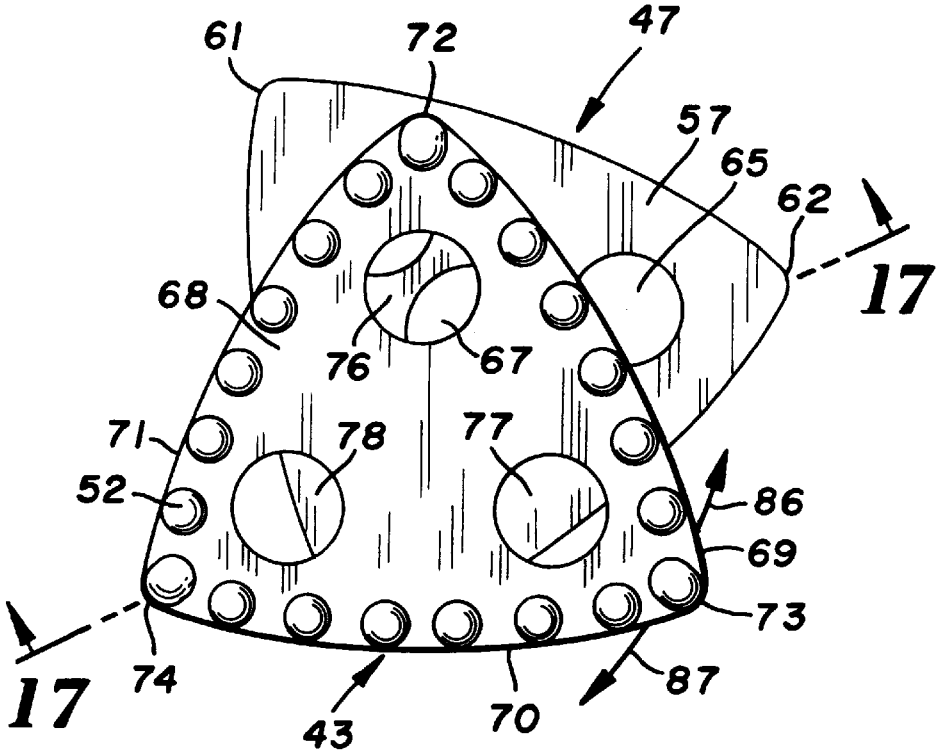
FIG. 16 is a top plan view of the sieve and pan cleaner showing the first member offset from the second member.
Figure 17:
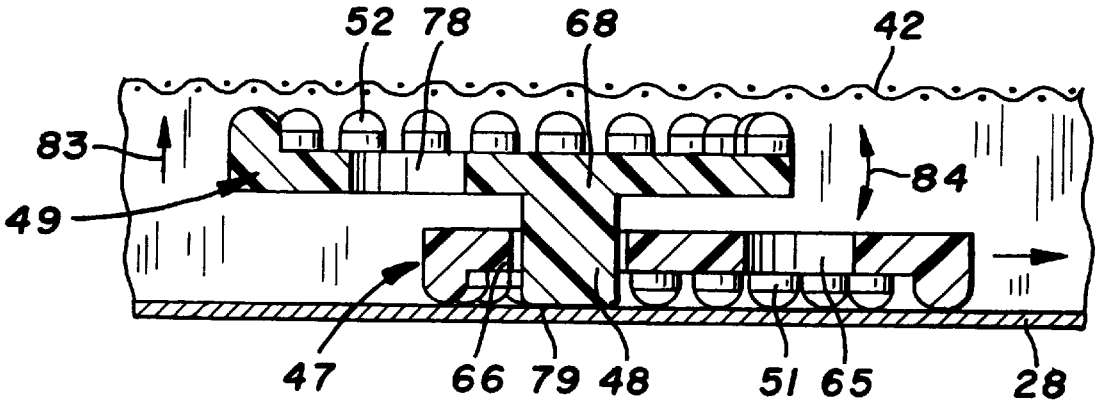
FIG. 17 is a sectional view taken along line 17—17 of FIG. 16.
Figure 18:
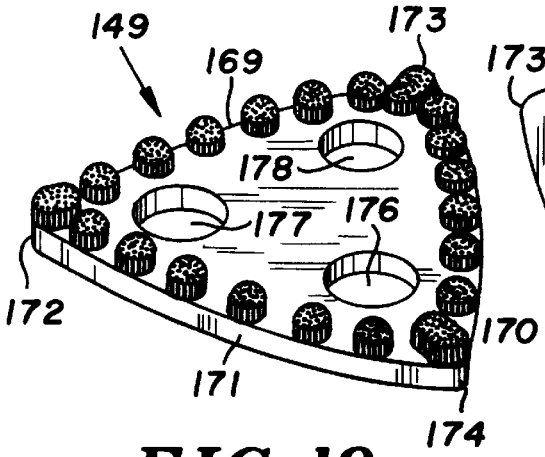
FIG. 18 is a perspective view of a first member of a modification of the sieve and pan cleaner.
Figure 21:
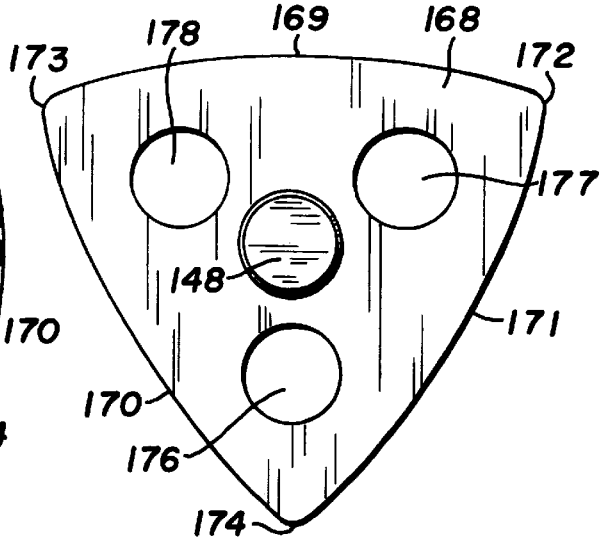
FIG. 21 is a bottom plan view of FIG. 18.
Figure 19:
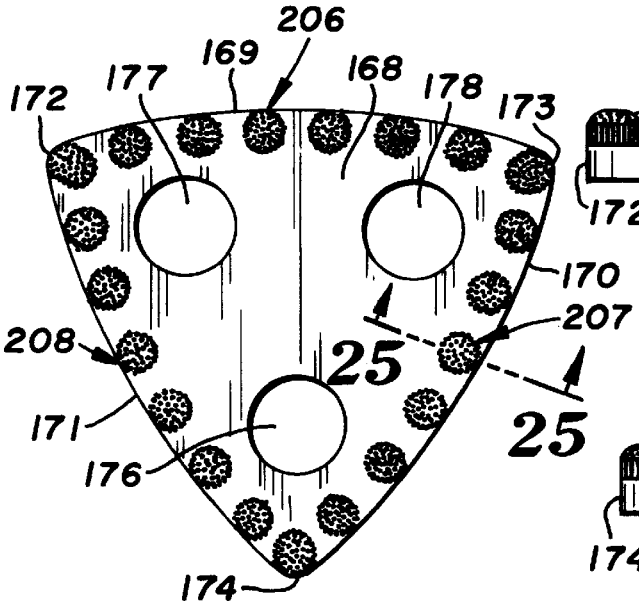
FIG. 19 is a top plan view of a first member of a modification of the sieve and pan cleaner.
Figure 22:
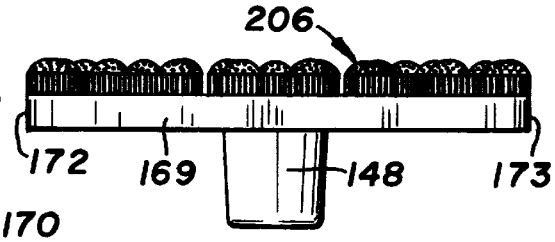
FIG. 22 is a top side elevational view of FIG. 19.
Figure 23:
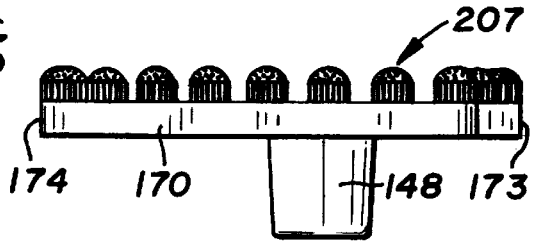
FIG. 23 is a right side elevational view of FIG. 19.
Figure 20:
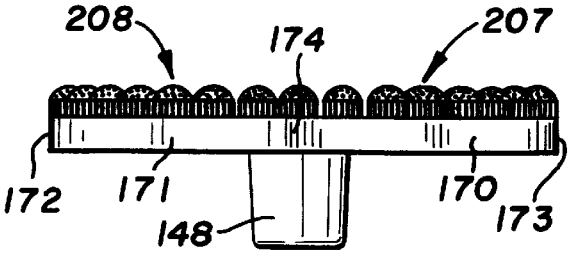
FIG. 20 is a bottom side elevational view of FIG. 19.
Figure 24:
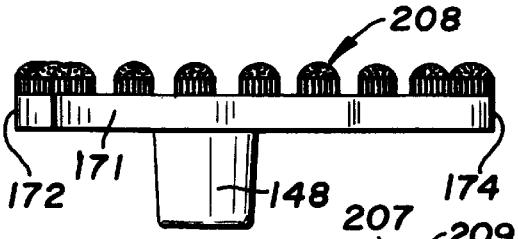
FIG. 24 is a left side elevational view of FIG. 19.

As shown in FIGS. 16 and 17, screen cleaning member 49 is laterally offset from pan cleaning member 47. Post 48 extended through hole 66 in member 47 rides on pan 28. Post 48 can be located in holes 64 and 65 in member 47. Screen cleaning member 47 has rotational and up and down movements and wobble movement as shown by arrows 83,84, 86, and 87. Pan cleaning member 47, in use, is free to extend into passage 30 below stop member 22 whereby the fingers 51 clean the top surface of pan 28 under member 22. Particulates do not collect in passages 21 and 30 as members 47 maintain these passages 21 and 30 open. The offset orientation of members 47 and 49 permit increased wobble of members 47 and 49 relative to each other and enhanced cleaning of pan 28 and screen 42.

Figure 33:
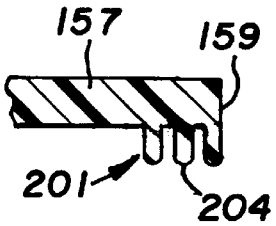
FIG. 33 is a sectional view taken along line 33—33 of FIG. 29.
Figure 30:
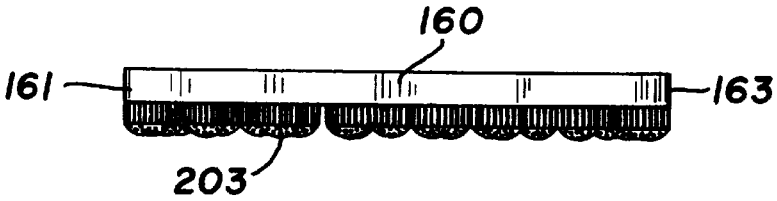
FIG. 30 is a bottom side elevational view of FIG. 27.
Figure 31:
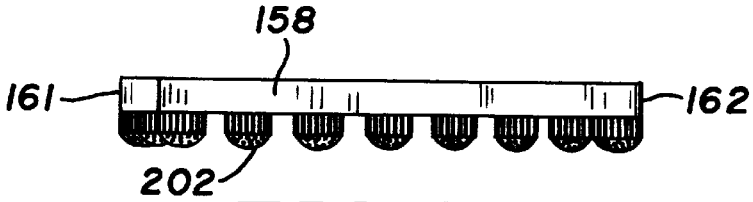
FIG. 31 is a top side elevational view of FIG. 27.
Figure 32:
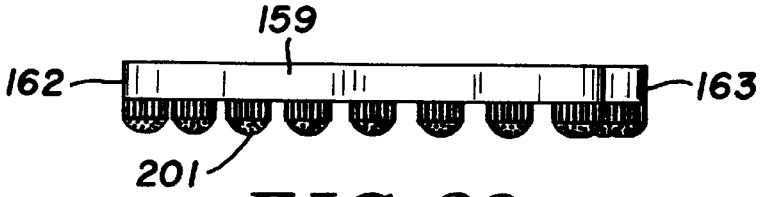
FIG. 32 is a side elevational view of FIG. 27.

Modifications of the pan cleaning member 147 and screen cleaning member 149 is shown in FIGS. 18 to 33. The parts of members 147 and 149 that correspond to the parts of members 47 and 49 have the same reference number with a prefix 1. The bottom of body 157 has rows of downwardly directed cleaning projections 201, 202, and 203 located along the outer periphery of body 157. As shown in FIG. 33, each cleaning projection or finger knob has a plurality of downwardly directed fingers or bristles 204 that ride on pan 28 to clear pan 28 of particulates. Fingers 204 are plastic or rubber-like cylindrical extensions of body 157. The number and sizes of fingers 204 of each projection can vary. A cleaning projection is located in each corner of body 157. The rows of cleaning projections extend between the corner cleaning projections. Adjacent cleaning projections are spaced from each other to allow particulates to flow past the projections 201, 202 and 203 and away from pan cleaning member 147.

Figure 25:
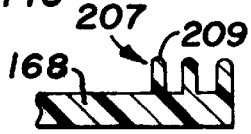
FIG. 25 is a sectional view taken along line 25—25 of FIG. 19.
Figure 26:
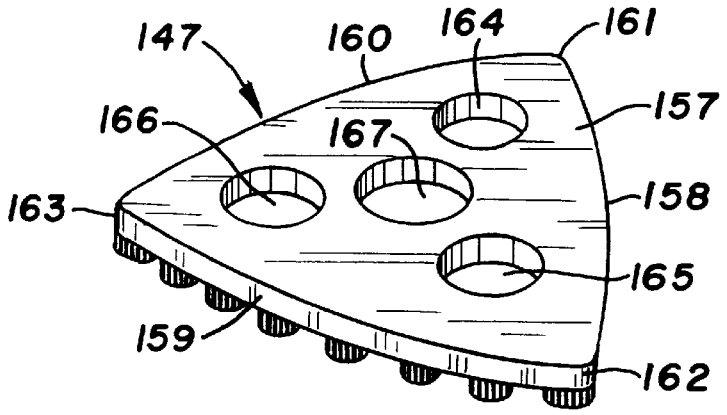
FIG. 26 is a perspective view of a second member of the modification of the sieve and pan cleaner.
Figure 27:
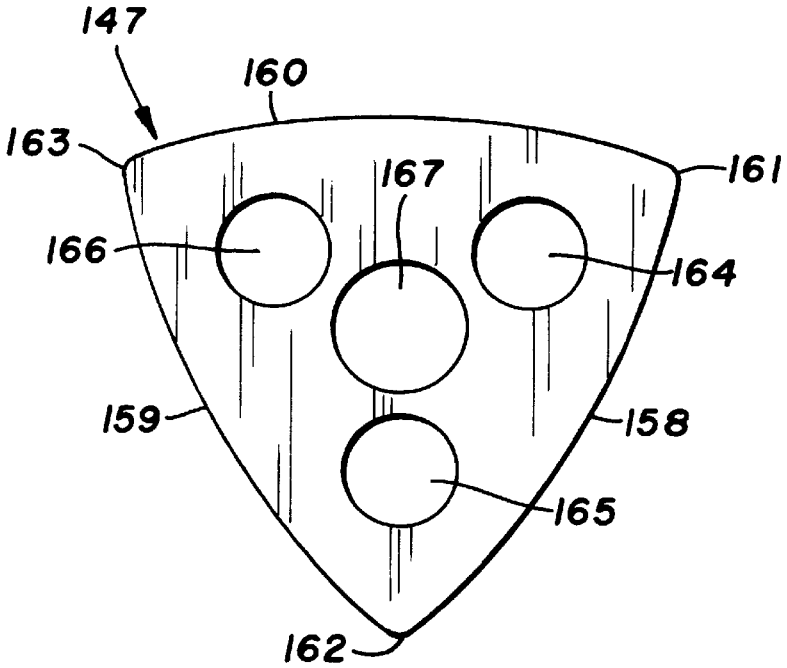
FIG. 27 is a top plan view of FIG. 26.
Figure 28:
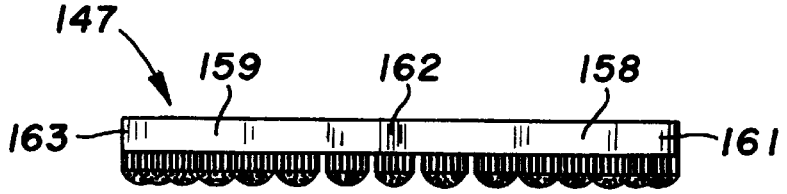
FIG. 28 is a bottom side elevational view of FIG. 27.
Figure 29:
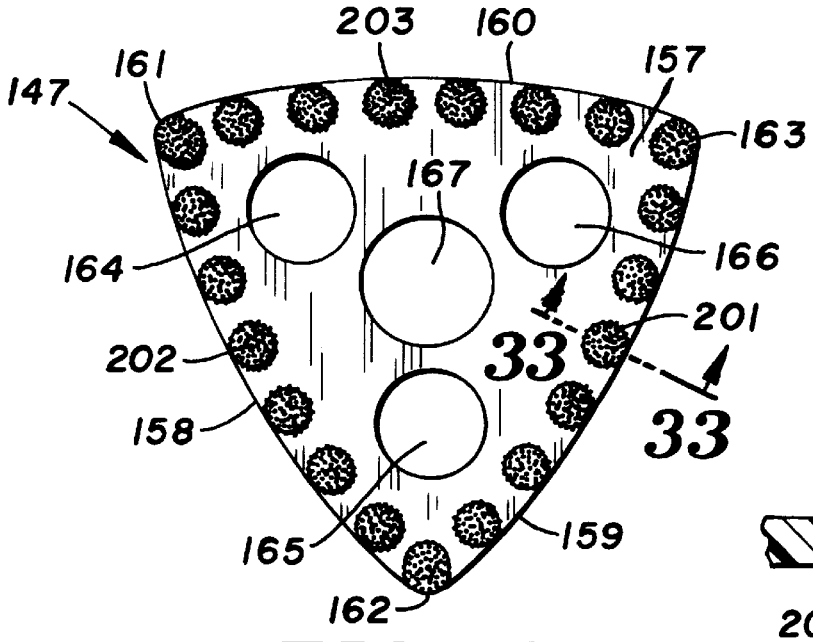
FIG. 29 is a bottom plan view of FIG. 27.

The screen cleaning member 149, shown in FIGS. 18 to 24, has rows of upwardly directed cleaning projections 206, 207 and 208 located along the outer peripheral edges of body 168. As shown in FIG. 25, each cleaning projection or knob has a plurality of upright fingers or bristles 209 that in use engage the screen 42 to clear particulates that are retained on the screen. Fingers 209 are plastic or rubber-like extensions of body 168. The number and sizes of fingers 209 of each cleaning projection can vary. Each corner of body 157 has a cleaning projection. Additional cleaning projections extend along sides 169, 170 and 171 between the corners projections. Adjacent cleaning projections of each row of projections are spaced from each other to allow particulates to flow past projections 206, 207 and 208 and away from member 149. Particulates also flow downward through holes 176, 177 and 178 to pan 28.

From the foregoing specification and drawings are directed to preferred embodiments of the sieve box and screen and base plate cleaners of the invention. It is understood that various changes and modifications in structures and materials may be made by persons skilled in the art without departing from the invention.

I claim:

1. A sieve box comprising: a frame having a plurality of first side members and a second side member, and a cross member secured to a pair of the first side members, said second side members being spaced from one of the first side members providing a coarse material discharge channel, a pan secured to the first side members and the cross member, a screen secured to the side members covering the area surrounded by the first side members and cross member, said screen being located above the pan, at least one of the first side members having an opening in communication with the chamber between the pan and screen to allow particulates to flow out of the chamber, and clearing means located in said chamber for clearing the screen and pan of particulates, said clearing means comprising a pan clearing member having a generally flat body, at least one hole having a vertical axis extended through said body, and downwardly directed first fingers joined to the body engageable with the pan for cleaning the pan of particulates, and a screen clearing member having upwardly directed second fingers located below the screen for clearing the screen of particulates, said screen clearing member having a downwardly directed post movably supported on the pan, said post extended through the hole in the body and having a cross section smaller than the cross section of said hole whereby the pan clearing member and screen clearing member are movably connected together to allow relative rotation of the members and relative vertical and wobble movements of the members to clear particulates from the pan and screen.

2. The sieve box of claim 1 including: a second cross member laterally spaced from the first cross member, means securing the second cross member to the pan and screen to divide the chamber between the pan and screen into zones, and separate cleaning means being located in each zone.

3. The sieve box of claim 1 wherein: the body of the pan clearing member has a generally triangular shape and three convex-shaped side walls.

4. The sieve box of claim 3 wherein: the first fingers are joined to the body adjacent said convex-shaped side walls.

5. The sieve box of claim 1 wherein: the adjacent first fingers are spaced from each other to allow particulates to flow between the first fingers.

6. The sieve box of claim 1 wherein: the body of the pan clearing member has a generally flat body and a generally triangular shape with three corners, said first fingers including a corner finger adjacent each corner, and a plurality of first fingers located between said corner fingers.

7. The sieve box of claim 6 wherein: said body has convex curved sides extended between adjacent corners.

8. The sieve box of claim 1 wherein: the body has a plurality of holes, said post extended through one of said holes.

9. The sieve box of claim 1 wherein: the first fingers of the pan clearing member comprise a plurality of groups of protrusions.

10. The sieve box of claim 1 wherein: the screen clearing member has a generally triangular shape and three convex-shaped side walls.

11. The sieve box of claim 10 wherein: the second fingers are located adjacent the convex-shaped side walls.

12. The sieve box of claim 1 wherein: adjacent second fingers on the screen clearing member are spaced from each other to allow particulate materials to flow between the second fingers.

13. The sieve box of claim 1 wherein: the screen clearing member has a generally triangular shape with three corners, said second fingers including a corner finger adjacent each corner and a plurality of second fingers located between said corner fingers.

14. The sieve box of claim 1 wherein: the second fingers include a plurality of pods of fingers.

15. The sieve box of claim 14 wherein: the pods of fingers are groups of elongated protrusions.

16. The sieve box of claim 1 wherein: the pan clearing member has a generally triangular shape, said screen clearing member having a generally triangular shape.

17. The sieve box of claim 16 wherein: the pan clearing member and screen clearing member each have convex-shaped side walls, said first and second fingers being joined to the members adjacent said convex-shaped side walls.

18. The sieve box of claim 17 wherein: each clearing member member has three corners, said first and second fingers including a corner finger adjacent each corner, and a plurality of first and second fingers located between said corner fingers.

19. The sieve box of claim 16 wherein: the fingers on each member include a plurality of pods of fingers.

20. The sieve box of claim 19 wherein: the pods of fingers are groups of protrusions.

21. A sieve box comprising: a frame, pan secured to the frame, a screen secured to the frame and extended substantially parallel to and spaced above said pan, clearing means located between said pan and screen for clearing particulates from the pan and screen, said clearing means comprising a first member having a plurality of first fingers adapted to engage the pan, and a second member having a plurality of second fingers adapted to engage the screen, said first and second members having cooperating means to movably connect the first and second members, said cooperating means comprising a post joined to the second member and a hole in the first member, said post extended through said hole engageable with the pan whereby the first and second members are free to rotate relative to each other and have vertical and wobble movements relative to each other.

22. The sieve box of claim 21 wherein: the first and second members each have a triangular body, said body having three side walls.

23. The sieve box of claim 22 wherein: the first and second fingers are joined to each body adjacent said side walls.

24. The sieve box of claim 23 wherein: the adjacent first and second fingers are spaced from each other to allow particulates to flow between said first and second fingers.

25. The sieve box of claim 21 wherein: the first and second members each have a generally flat triangular body with three corners and convex-shaped side walls extended between said corners, said first and second fingers each having corner fingers adjacent said corners, and a plurality of fingers located between said corner fingers.

26. The sieve box of claim 21 wherein: said first and second fingers each comprise a plurality of groups of protrusions.

27. The sieve box of claim 21 wherein: the post is a cylindrical post joined to the second member, said hole is a circular hole having a diameter larger than the diameter of the cylindrical post, said cylindrical post being extended through said circular hole whereby the first and second members have rotational, vertical, and wobble movements relative to each other.

28. The sieve box of claim 21 wherein: the first member has a plurality of holes, said post on the second member being extended through one of said holes.

29. A device for clearing particulates from a pan and screen of a sieve box comprising: a first member having a plurality of first fingers adapted to engage the pan, and a second member having a plurality of second fingers adapted to engage the screen, said first and second members having cooperating means to movably connect the first and second members, said cooperating means comprising a post joined to the second member and a hole in the first member, said post extended through said hole whereby the first and second members have rotational, vertical, and wobble movements relative to each other.

30. The device of claim 29 wherein: the first and second members each have a generally triangular body, said body having three side walls.

31. The device of claim 30 wherein: the first and second fingers are joined to each body adjacent said side walls.

32. The device of claim 29 wherein: the adjacent first and second fingers are spaced from each other to allow particulates to flow between said first and second fingers.

33. The device of claim 29 wherein: the first and second members each have a generally flat triangular body with three corners and convex-shaped side walls extended between said corners, said first and second fingers each having corner fingers adjacent said corners, and a plurality of fingers located between said corner fingers.

34. The device of claim 29 wherein: said first and second fingers each comprise a plurality of groups of protrusions.

35. The device of claim 29 wherein: the post is a cylindrical post joined to the second member, said hole is a circular hole having a diameter larger than the cylindrical post, said cylindrical post being extended through said circular hole whereby the first and second members have rotational, vertical, and wobble movements relative to each other.

36. The device of claim 29 wherein: the first member has a plurality of holes, said post on the second member extended through one of said holes.

* * * * *